US011008773B1

(12) United States Patent
Gallego

(10) Patent No.: US 11,008,773 B1
(45) Date of Patent: May 18, 2021

(54) COLLAPSIBLE PERGOLA

(71) Applicant: Teresa L. Gallego, Phoenix, AZ (US)

(72) Inventor: Teresa L. Gallego, Phoenix, AZ (US)

( * ) Notice: Subject to any disclaimer, the term of this patent is extended or adjusted under 35 U.S.C. 154(b) by 0 days.

(21) Appl. No.: 16/665,515

(22) Filed: Oct. 28, 2019

Related U.S. Application Data

(60) Provisional application No. 62/750,984, filed on Oct. 26, 2018.

(51) Int. Cl.

| | |
|---|---|
| ***E04H 15/48*** | (2006.01) |
| ***E04H 1/12*** | (2006.01) |
| ***E04B 1/344*** | (2006.01) |
| ***E04H 15/00*** | (2006.01) |
| ***E04H 15/02*** | (2006.01) |
| ***E04F 10/08*** | (2006.01) |
| *A47B 3/14* | (2006.01) |

(52) U.S. Cl.
CPC ..... *E04H 15/48* (2013.01); *E04B 1/3445* (2013.01); *E04F 10/08* (2013.01); *E04H 1/1205* (2013.01); *E04H 15/008* (2013.01); *E04H 15/02* (2013.01); *A47B 3/14* (2013.01)

(58) Field of Classification Search
CPC . E04B 1/3445; E04B 1/34357; E04H 1/1205; E04H 15/008; E04H 15/48; A47B 3/14; A47B 83/02; A47B 83/021; A47B 83/023; A47B 83/024; A47B 83/025; A47B 83/0215; A47B 83/0213
USPC ..... 52/36.4, 71, 79.5; 211/149, 201; 135/143; 297/157.1–159.1; 108/92, 99, 108/115
See application file for complete search history.

(56) References Cited

U.S. PATENT DOCUMENTS

| | | | | | |
|---|---|---|---|---|---|
| 435,604 | A * | 9/1890 | Hasselman | E04B 1/3445 | 52/70 |
| 456,307 | A * | 7/1891 | Hodson | E04B 1/3445 | 52/70 |
| 1,045,854 | A * | 12/1912 | Kevitt et al. | E04B 1/3445 | 52/70 |
| 1,903,954 | A * | 4/1933 | Blumenthal | A47B 83/02 | 297/158.2 |
| 1,961,915 | A * | 6/1934 | Salmen, Jr. | E04H 15/324 | 135/153 |
| 2,293,569 | A * | 8/1942 | Sonion | E04B 1/3445 | 52/71 |
| 2,717,429 | A * | 9/1955 | Nead | E04B 1/3445 | 52/32 |
| 2,765,498 | A * | 10/1956 | Kelnhofer | E04B 1/3445 | 52/70 |
| 2,890,498 | A * | 6/1959 | Bigelow | E04H 15/008 | 52/69 |
| 3,173,436 | A * | 3/1965 | Peters | E04H 15/48 | 52/36.1 |

(Continued)

FOREIGN PATENT DOCUMENTS

| | | | | |
|---|---|---|---|---|
| EP | 3527737 A1 * | 8/2019 | E04B 1/3447 | |

*Primary Examiner* — Robert Canfield
(74) *Attorney, Agent, or Firm* — Cramer Patent & Design, PLLC; Aaron R. Cramer

(57) ABSTRACT

A collapsible pergola comprising a traditionally configured pergola having a plurality of locking hinge mechanisms disposed about each section of the pergola thereby enabling the pergola to be unfolded to set up or folded up to store away in a low-profile manner requiring no assembly or disassembly of the pergola by the user.

15 Claims, 4 Drawing Sheets

(56) References Cited

U.S. PATENT DOCUMENTS

| | | | | |
|---|---|---|---|---|
| 4,271,766 | A * | 6/1981 | Schmiedeler | A47B 43/02 108/115 |
| 4,541,214 | A | 9/1985 | Lambert | |
| 5,257,701 | A * | 11/1993 | Edelson | A47B 3/10 108/116 |
| 7,900,417 | B1 | 3/2011 | Leines | |
| 8,061,106 | B2 | 11/2011 | Clark | |
| 8,640,420 | B1 | 2/2014 | Halley | |
| 9,145,683 | B2 | 9/2015 | Matys | |
| D788,940 | S | 6/2017 | Lavery et al. | |
| D788,942 | S | 6/2017 | Lavery et al. | |
| 9,777,477 | B2 | 10/2017 | Capati | |
| 2004/0238469 | A1* | 12/2004 | Ng | A47B 43/00 211/149 |
| 2009/0014044 | A1* | 1/2009 | Hartman | E04B 1/3445 135/143 |
| 2020/0347626 | A1* | 11/2020 | Petty | E04H 1/1272 |

* cited by examiner

COLLAPSIBLE PERGOLA

RELATED APPLICATIONS

The present invention is a continuation of, was first described in, and claims the benefit of U.S. Provisional Application No. 62/750,984 filed Oct. 26, 2018, the entire disclosures of which are incorporated herein by reference.

FIELD OF THE INVENTION

The present invention relates to a pergola configurable between a deployed state and a collapsed state.

BACKGROUND OF THE INVENTION

Landscaping and outdoor features are common decorations that people use to enhance their outdoor property. Such features that can be used as both a landscaping feature and a seating and resting facility is a pergola. Pergolas provide a way for crawling or hanging vegetation such as ivy, hops, grapes, or hanging baskets to be trained and displayed, and also provide seating and perhaps a horizontal table surface.

Usually pergolas are constructed out of wooden or composite materials and are permanent fixtures in the ground. This permanent installation lends itself to damage due to weathering and other incidental damage and can also only be associated with the vegetation that is established in the ground. There is a benefit to having a pergola that is capable of collapsing into a transportable state and transforming into a fully erected pergola positioned at a desired location, whether it is for a quick getaway or a lengthier use. Such a pergola would also benefit from being collapsed into as compact a state as possible and also be lightweight and easy to erect when needed. The use of the collapsible pergola as described herein fulfills this purpose.

SUMMARY OF THE INVENTION

The principles of the present invention provide for a pergola, comprising a first side section having a first side section frame that partitions the first side section into a first side section upper opening, a first bench subjacent the first side section opening, and a first side section lower opening subjacent the first bench. The first side section has a first side which is hingedly connected to a first side of the first rear section. The pergola also comprises a second side section having a second side section frame that partitions the second side section into a second side section upper opening, a second bench subjacent the second side section opening, and a second side section lower opening subjacent the second bench. The second side section has a first side hingedly connected to a first side of the first rear section. The pergola also comprises a first rear section which includes a first rear frame partitioning the first rear section into a first rear upper opening and a first rear lower opening, a second rear section including a second rear frame which partitions the second rear section into a second rear upper opening and a second rear lower opening.

The pergola also comprises a table which has a first table half and a second table half that deploys from the first rear section and the second rear section, respectively. The first table half is hingedly attached to a location on the first rear frame and the second table half is hingedly attached to a location on the second rear frame. The pergola also comprises a first bench which has a first perimeter bottom edge hingedly attached to a portion of the first side section frame.

The first bench deploys from the first side section. The pergola also comprises a second bench which has a first perimeter bottom edge hingedly attached to a portion of the second side section frame with a width generally minimally shorter that a width of the second side section. The second bench deploys from the second side section. The pergola also comprises a pair of second bench legs located hingedly attached to opposing front corners of the bottom surface of the second bench. The pair of second bench legs are deployed to enable the second bench to be supported in a horizontal orientation.

The pergola also comprises a first table leg which is hingedly attached to the bottom surface of the first table half and is deployed to enable the first table half to be supported in a horizontal orientation, a second table leg which is hingedly attached to the bottom surface of the second table half and is deployed to enable the second table half to be supported in a horizontal orientation, a plurality of locking hinges which securely holds the sections, the table halves, and the benches together in a folded configuration until selectively released by the locking hinges and a top edge of the first side section which is hingedly connected to is a rear edge of a first roof panel and a top edge of the second side section is hingedly connected to is a rear edge of a second roof panel. The rear corner of the first roof panel at a first side is capable of removably attaching to a second upper front corner of the first rear section. The pergola also comprises a front support utilized to provide structural support of the roof panels. The front support is pivotally attached to the first side section frame and is hingedly attached to the second side frame.

The first side section and the second side section may be essentially mirror images of each other. The first table half may be rectangular in shape and may have a width smaller than that of the length of the first bench so as to not contact it when both are deployed. Each of the sections may be rectangular in shape. The second table half may be rectangular in shape having a width smaller than the length of the second bench so as to not contact it when both are deployed. The first table half and the second table half may be oriented when deployed so as to provide a continuous planar surface.

The first table half and the second table half may be provided with at least one locking hinge to aid in securing them together for structural rigidity. A pair of first bench legs may be hingedly attached to opposing front corners of the bottom surface of the first bench and are deployed to enable the first bench to be supported in a horizontal orientation. A first bench back may be permanently fastened to the first side section frame and may be coextensive with the width of the first bench.

The front face of the first bench back may be fully concealed when the first bench is in the folded configuration and uncovered when the first bench is deployed. A second bench back may be permanently fastened to the second side section frame and is coextensive with the width of the second bench. The front face of the second bench back may be fully concealed when the second bench is in the folded configuration and is uncovered when the second bench is deployed. The roof panels may generally be of a slatted construction that at least partially enabling light to filter through. The slatted construction may be oriented where the slats lay on top of and are secured to a perimeter frame in a lateral fashion projecting from the respective side sections towards the center.

The pergola may be made of a material selected from the group consisting of wooden material, composite material, weatherproof material, or resilient material. The pergola may be in a folded configuration and boxed for shipment and storage prior to use. The folded configuration is in an accordion shape. The folded configuration may be in a tri-fold shape. At least one clamp may be provided to maintain the pergola in the folded configuration. The at least one clamp may be removed to deploy the pergola.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
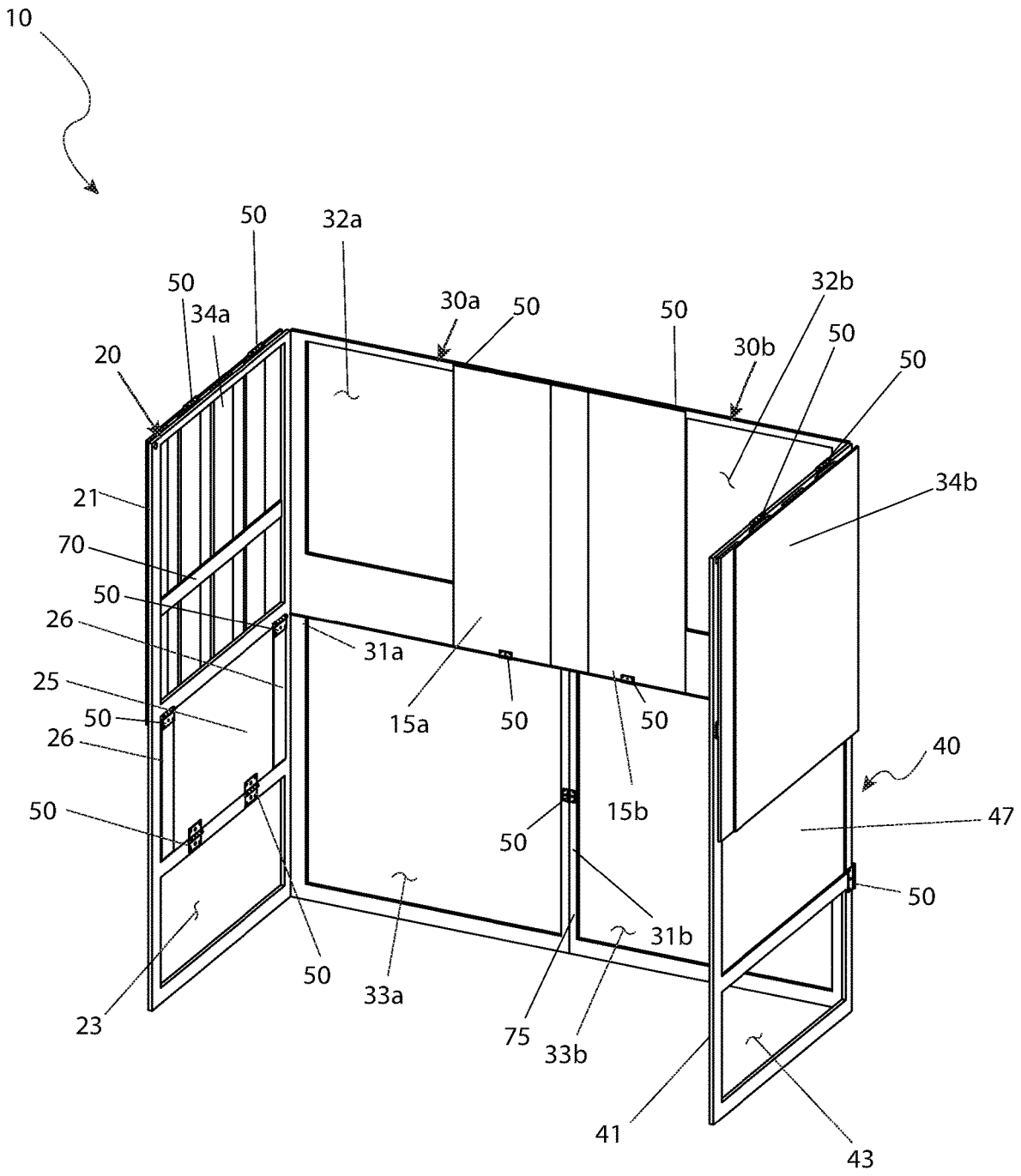
FIG. 1 is a perspective view of the pergola 10 in a partially erected state, wherein the roof panels 34*a*, 34*b*, table panels 61*a*, 61*b*, and bench panels 25, 45 are collapsed.

10 pergola
15*a* first table half
15*b* second table half
17*a* first table leg
17*b* second table leg
20 first side section
21 first side section frame
22 first side section upper opening
23 first side section lower opening
25 first bench
26 first bench leg
27 first bench back
30*a* first rear section
30*b* second rear section
31*a* first rear frame
31*b* second rear frame
32*a* first rear upper opening
32*b* second rear upper opening
33*a* first rear lower opening
33*b* second rear lower opening
34*a* first roof panel
34*b* second roof panel
40 second side section
41 second side frame
42 second side upper opening
43 second side lower opening
45 second bench
46 second bench leg
47 second bench back
50 locking hinge
70 front support

1. Description of the Invention

Figure 2:
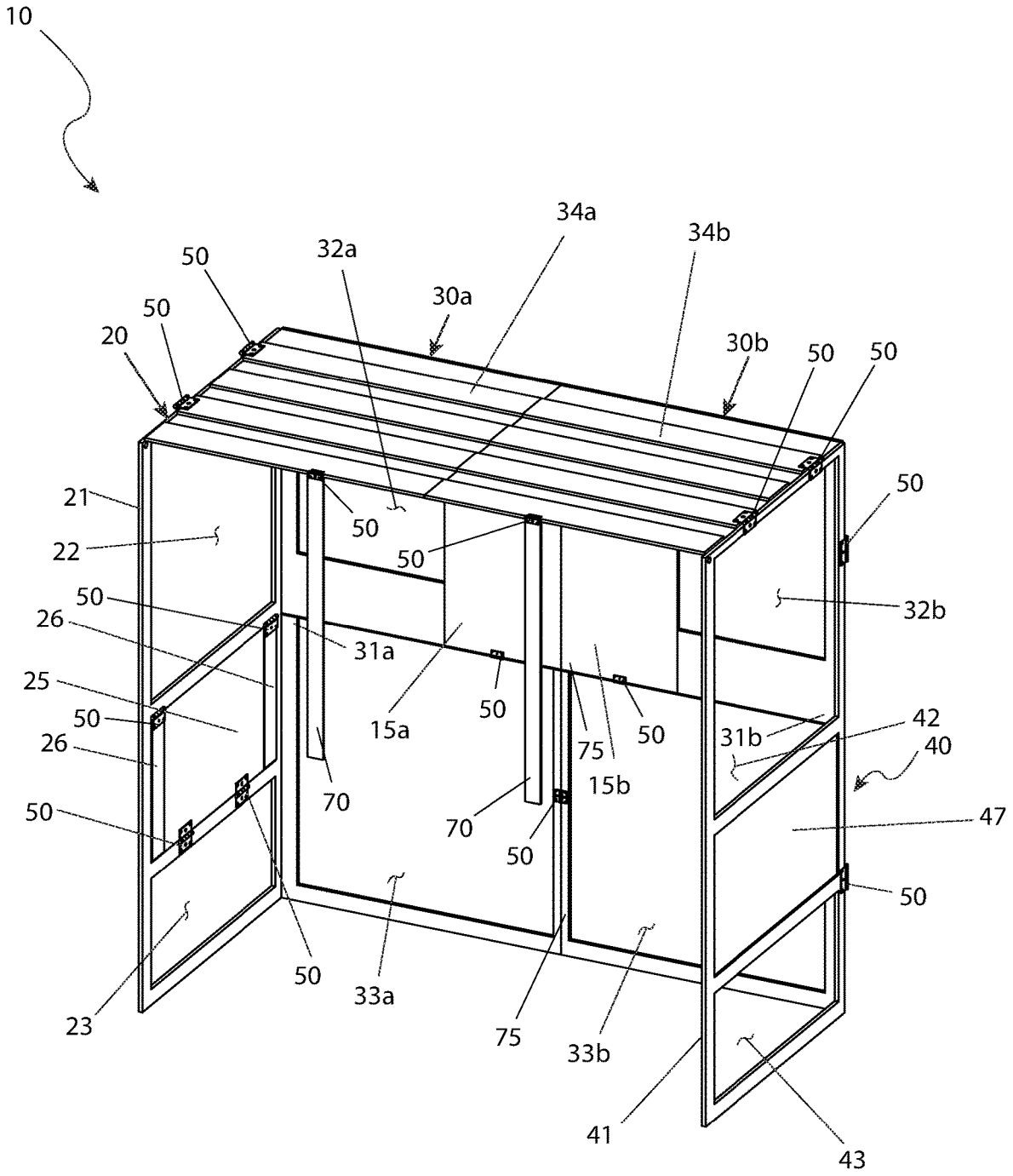
FIG. 2 is a perspective view of the pergola 10 in a partially erected state, wherein the roof panels 34*a*, 34*b*, table panels 61*a*, 61*b*, and bench panels 25, 45 are collapsed.
Figure 3:
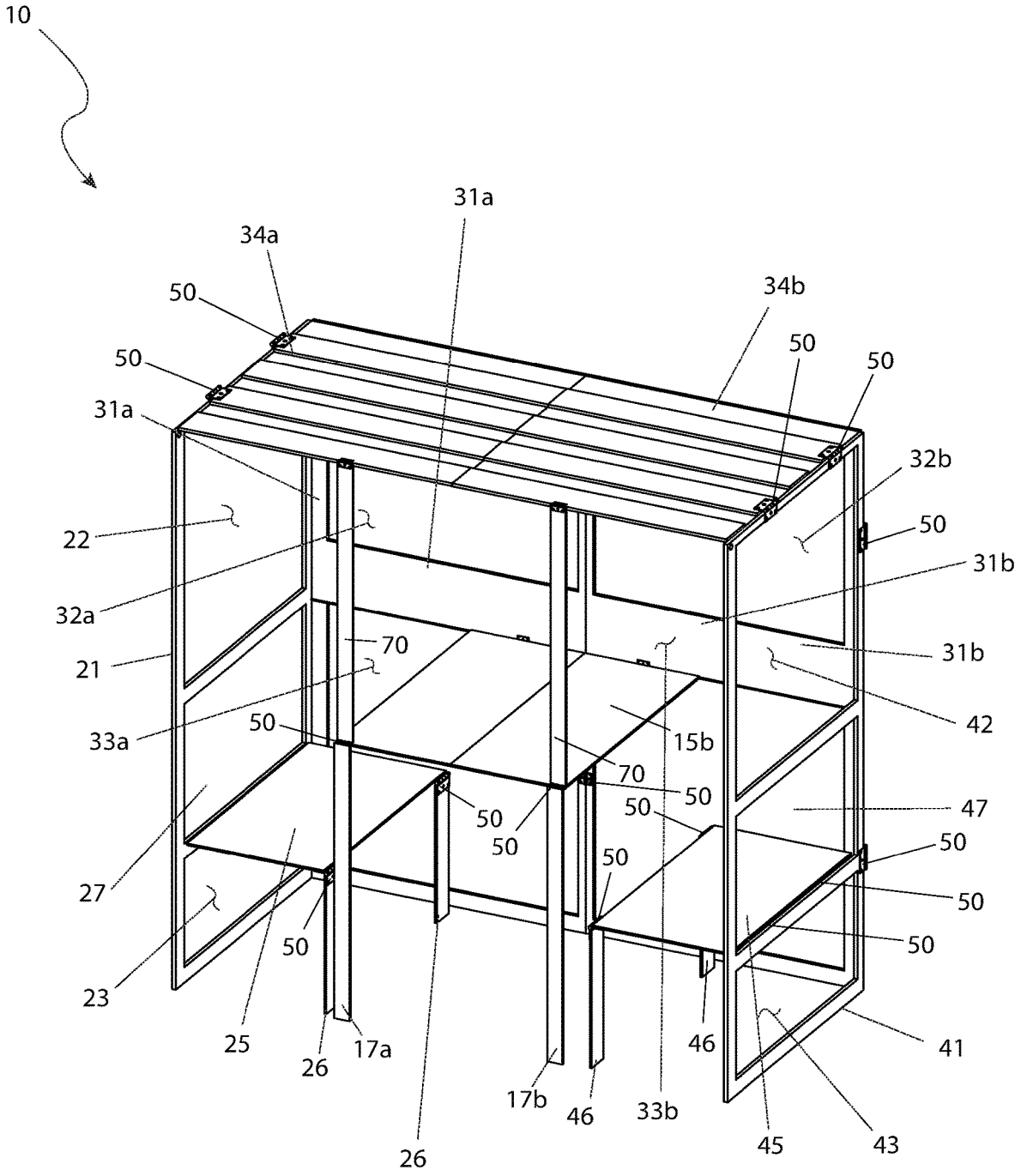
FIG. 3 is a perspective view of the pergola 10 in a fully erected state; and, FIG. 4 is a front elevation view of the pergola 10 of FIG. 3.
Figure 4:
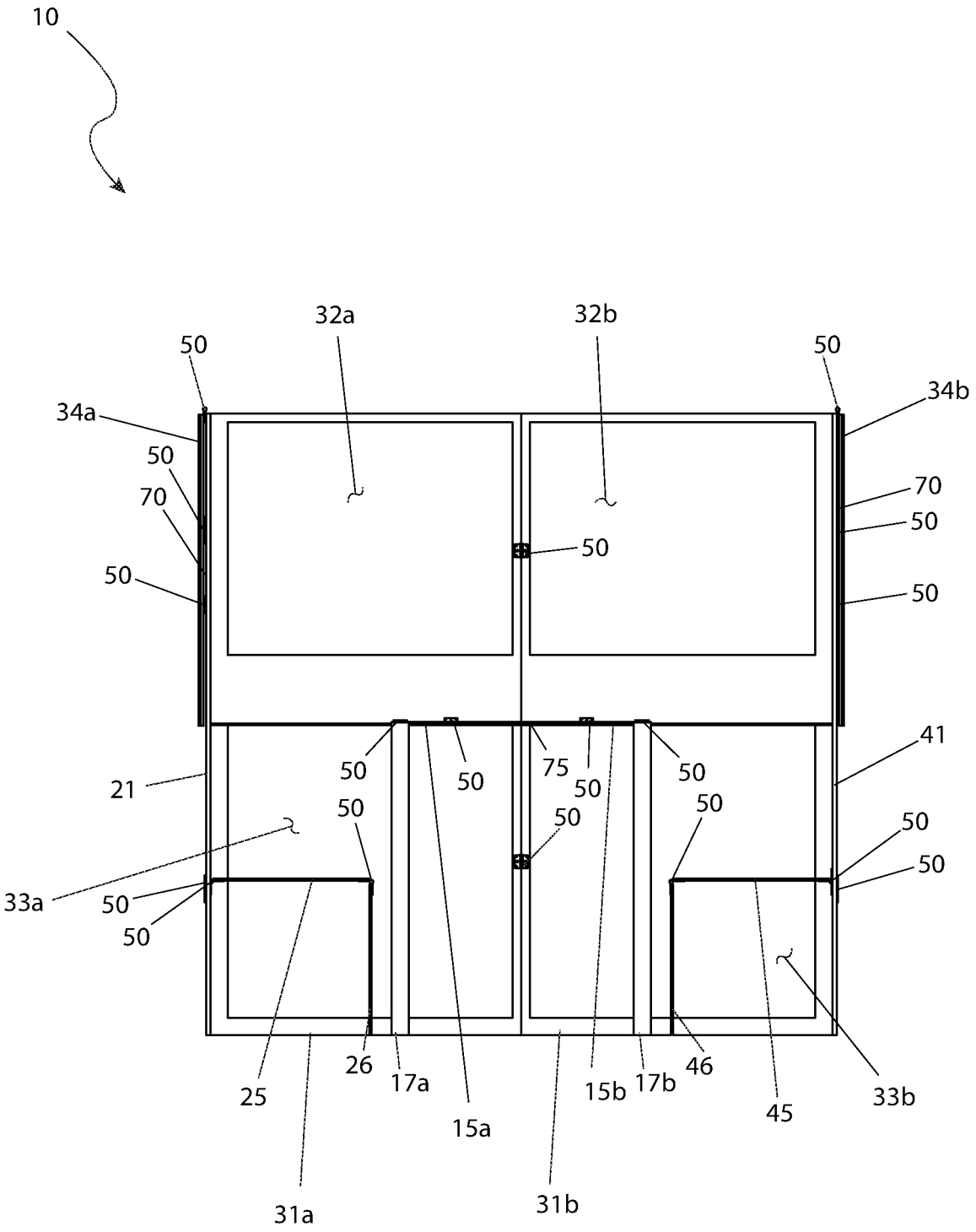

The best mode for carrying out the invention is presented in terms of its preferred embodiment, herein depicted within FIGS. 1-4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

The pergola 10 is preferably fabricated out of wooden or composite material that is generally weatherproof and resilient or is coated with such materials. The pergola 10 is partitioned into a first side section 20, a second side section 40, a first rear section 30*a*, and a second rear section 30*b*. A table comprising a first table half 15*a* and second table 15*b* deploys from the first rear section 30*a* and the second rear section 30*b*, respectively. A first bench 25 deploys from the first side section 20 and a second bench 45 deploys from the second side section 40. A plurality of locking hinges 50 securely holds the sections 20, 30*a*, 30*b*, 40, table halves 15*a*, 15*b*, and benches 25, 45 together in a folded configuration until selectively released by the locking hinge 50. The locking hinge 50 is envisioned to be commonly available in a wide variety of styles that allow for the separation and rejoining of various surfaces at various degrees of mating. As such, the use of a specific style of locking hinge 50 is not envisioned to be a limiting factor of the present invention. The pergola 10 is envisioned to be available in the folded configuration and boxed for shipment and storage prior to and/or after use. Such a folded configuration can be like an accordion or tri-fold shape (i.e., "W"-shaped fold). Although not shown, it is in the scope of the invention to provide at least one (1) clamp or other similar device to maintain the pergola 10 in the folded configuration, which is capable of being removed to begin the deployment process.

FIGS. 1-4 illustrate various views of deployment of the pergola 10.

The first side section 20 and second side section 40 are essentially mirror images of each other. The first side section 20 has a first side hingedly connected to a first side of the first rear section 30*a*. The second side section 40 has a first side hingedly connected to a second side of the second rear section 30*b*. The first rear section 30*a* has a second side hingedly connected to a first side of the second rear section 30*b*. Each section 20, 30*a*, 30*b*, 40 are rectangular in size. Hingedly connected to a top edge of the first side section 20 is a rear edge of a first roof panel 34*a*. The rear corner of the first roof panel 34*a* at a first side is capable of removably attaching to a second upper front corner (i.e., opposite of the first rear section 30*a*) of the first rear section 30*a*. Similarly, hingedly connected to a top edge of the second side section 40 is a rear edge of a second roof panel 34*b*. The rear t corner of the second roof panel 34*b* at a second side is capable of removably attaching to a second upper front corner (i.e., opposite of the second rear section 30*b*) of the second rear section 30*b* The roof panels 34*a*, 34*b* are generally a slatted construction capable of at least partially enabling light to filter through. It is preferred that the slatted construction is oriented where individual slats lay on top of and are secured to a perimeter frame in a lateral (e.g. projecting from the respective side section 20, 40 towards the center). A front support 70 is utilized to provide structural support of the roof panels 34*a*, 34*b* as shown along its front edge. The front support is pivotally attached to the first side section frame 21 and hingedly attached to the second side frame 41.

The first side section 20 has a first side section frame 21 that partitions the first side section 20 into a first side section upper opening 22, a first bench 25 subjacent the first side section opening 22, and a first side section lower opening 23 subjacent the first bench 25. Similarly, the second side section 40 has a second side section frame 41 that partitions the second side section 40 into a second side section upper opening 42, a second bench 45 subjacent the second side section opening 42, and a second side section lower opening 43 subjacent the second bench 45. The first rear section 30*a* also employs a first rear frame 31*a* partitioning the first rear section 30*a* into a first rear upper opening 32*a* and a first rear lower opening 33*a*. Similarly, the second rear section 30*b* also employs a second rear frame 31*b* partitioning the second rear section 30*b* into a second rear upper opening 32*b* and a second rear lower opening 33*b*.

The first bench 25 has a first perimeter bottom edge hingedly attached to a portion of the first side section frame 21 with a width generally minimally shorter that a width of the first side section 20. A pair of first bench legs 26 is hingedly attached to opposing front corners of the bottom surface of the first bench 25 and can be deployed to enable the first bench 25 to be supported in a horizontal orientation. Permanently fastened to the first side section frame 21 and coextensive with the width of the first bench 25 is a first bench back 27. The front face of the first bench back 25 is fully concealed when the first bench 25 is in the folded configuration and uncovered when the first bench 25 is deployed.

The second bench 45 has a first perimeter bottom edge hingedly attached to a portion of the second side section frame 41 with a width generally minimally shorter that a width of the second side section 40. A pair of second bench legs 46 located is hingedly attached to opposing front corners of the bottom surface of the second bench 45 and can be deployed to enable the second bench 45 to be supported in a horizontal orientation. Permanently fastened to the second side section frame 41 and coextensive with the width of the second bench 45 is a second bench back 47. The front face of the second bench back 45 is fully concealed when the second bench 45 is in the folded configuration and uncovered when the second bench 45 is deployed.

The first table half 15*a* is preferably rectangular in shape and having a width smaller than that of the length of the first bench 25 so as to not contact it when both are deployed. The first table half 15*a* is hingedly attached to a location on the first rear frame 31*a* and can have any desired length. A first table leg 17*a* is hingedly attached to the bottom surface of the first table half 15*a* and can be deployed to enable the first table half 15*a* to be supported in a horizontal orientation. Similarly, the second table half 15*b* is preferably rectangular in shape and having a width smaller than that of the length of the second bench 45 so as to not contact it when both are deployed. The second table half 15*b* is hingedly attached to a location on the second rear frame 31*b* and can have any desired length. A second table leg 17*b* is hingedly attached to the bottom surface of the second table half 15*b* and can be deployed to enable the second table half 15*b* to be supported in a horizontal orientation. It is preferred that the first table half 15*a* and second table half 15*b* be oriented when deployed so as to provide a continuous planar surface. The first table half 15*a* and the second table half 15*b* are provided with at least one (1) locking hinge 50 to aid in securing the two components together for structural rigidity.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A pergola, comprising:

a first side section having a first side section frame that partitions the first side section into a first side section upper opening, a first bench subjacent the first side upper section opening, and a first side section lower opening subjacent the first bench, the first side section has a first side hingedly connected to a first side of a first rear section; the first rear section including a first rear frame partitioning the first rear section into a first rear upper opening and a first rear lower opening;

a second side section having a second side section frame that partitions the second side section into a second side section upper opening, a second bench subjacent the second side section upper opening, and a second side section lower opening subjacent the second bench, the second side section has a first side hingedly connected to a first side of a second rear section; the second rear section including a second rear frame partitioning the second rear section into a second rear upper opening and a second rear lower opening;

a table having a first table half and a second table half that deploy from the first rear section and the second rear section, respectively, the first table half is hingedly attached to a location on the first rear frame and the second table half is hingedly attached to a location on the second rear frame;

the first bench having a first perimeter bottom edge hingedly attached to a portion of the first side section frame, the first bench deploying from the first side section;

the second bench having a first perimeter bottom edge hingedly attached to a portion of the second side section frame with a width generally minimally shorter that a width of the second side section, the second bench deploying from the second side section;

a pair of second bench legs located hingedly attached to opposing front corners of the bottom surface of the second bench, the pair of second bench legs are deployed to enable the second bench to be supported in a horizontal orientation;

a first table leg hingedly attached to the bottom surface of the first table half and is deployed to enable the first table half to be supported in a horizontal orientation;

a second table leg hingedly attached to the bottom surface of the second table half and is deployed to enable the second table half to be supported in a horizontal orientation;

a plurality of locking hinges securely holding the sections, the table halves, and the benches together in a folded configuration until selectively released by the locking hinges;

a top edge of the first side section is hingedly connected to a rear edge of a first roof panel and a top edge of the second side section is hingedly connected to a rear edge of a second roof panel, the rear corner of the first roof panel at a first side is capable of removably attaching to an upper front corner of the first rear section; and two front supports each front support utilized to provide structural support of a respective roof panel.

2. The pergola according to claim 1, wherein the first side section and the second side section are essentially mirror images of each other.

3. The pergola according to claim 1, wherein the first table half is rectangular in shape and having a width smaller than that of the length of the first bench so as to not contact it when both are deployed.

4. The pergola according to claim 1, wherein each of the sections is rectangular in shape.

5. The pergola according to claim 1, wherein the second table half is rectangular in shape having a width smaller than the length of the second bench so as to not contact it when both are deployed.

6. The pergola according to claim 1, wherein the first table half and the second table half are oriented when deployed so as to provide a continuous planar surface.

7. The pergola according to claim 1, wherein the first table half and the second table half are provided with at least one locking hinge to aid in securing them together for structural rigidity.

8. The pergola according to claim 1, wherein a pair of first bench legs is hingedly attached to opposing front corners of the bottom surface of the first bench and are deployed to enable the first bench to be supported in a horizontal orientation.

9. The pergola according to claim 1, wherein a first bench back is permanently fastened to the first side section frame and is coextensive with the width of the first bench.

10. The pergola according to claim 9, wherein a front face of the first bench back is fully concealed when the first bench is in the folded configuration and uncovered when the first bench is deployed.

11. The pergola according to claim 1, wherein a second bench back is permanently fastened to the second side section frame and is coextensive with the width of the second bench.

12. The pergola according to claim 11, wherein a front face of the second bench back is fully concealed when the second bench is in the folded configuration and is uncovered when the second bench is deployed.

13. The pergola according to claim 1, wherein the roof panels are generally of a slatted construction that at least partially enable light to filter through.

14. The pergola according to claim 13, wherein the slatted construction is oriented where the slats lay on top of and are secured to a perimeter frame in a lateral fashion projecting from the respective side sections towards the center.

15. The pergola according to claim 1, wherein the pergola is made of a material selected from the group consisting of wooden material, composite material, weatherproof material, or resilient material.

* * * * *